US005883556A

United States Patent [19]

Shutes

[11] Patent Number: 5,883,556

[45] Date of Patent: Mar. 16, 1999

[54] REED SWITCH

[75] Inventor: Bradley E. Shutes, Maryland Heights, Mo.

[73] Assignee: C.P. Clare Corporation, Beverly, Mass.

[21] Appl. No.: 990,620

[22] Filed: Dec. 15, 1997

[51] Int. Cl.[6] ..... H01H 1/00

[52] U.S. Cl. ..... 335/57; 335/154

[58] Field of Search ..... 335/57, 59, 60, 335/151–4

[56] References Cited

U.S. PATENT DOCUMENTS

| | | | |
|---|---|---|---|
| 3,218,406 | 11/1965 | Gomperts et al. . | |
| 3,258,557 | 6/1966 | Scheepstra et al. . | |
| 3,283,274 | 11/1966 | De Falco . | |
| 3,288,972 | 11/1966 | Angermaier | 335/151 |
| 3,866,007 | 2/1975 | Shlesinger, Jr. et al. . | |
| 3,893,051 | 7/1975 | Shlesinger, Jr. et al. . | |
| 3,934,214 | 1/1976 | Archer | 335/151 |
| 3,943,474 | 3/1976 | Shlesinger, Jr. et al. . | |
| 4,039,985 | 8/1977 | Shlesinger et al. | 335/153 |
| 4,191,935 | 3/1980 | Archer et al. | 335/154 |

*Primary Examiner*—Lincoln Donovan
*Attorney, Agent, or Firm*—Lappin & Kusmer LLP

[57] ABSTRACT

A reed switch employs contact blades which have enhanced flexibility and performance, as a result of the selective removal of material from one or more of the blades without work hardening the remaining blade material. The blades are masked and acid etched in predetermined patterns to provide either a contact region, a hinge or fulcrum region, or one or more of both. The contact region of the blade optimizes the alignment and magnetic coupling of the switch while minimizing the electrical capacitance in the space between the blades when the switch is open. The hinge or fulcrum region improves blade compliance and flexibility under an applied load. Various geometries of the contact region can be employed to improve the performance and longevity of the switch.

25 Claims, 5 Drawing Sheets

REED SWITCH

TECHNICAL FIELD

The present invention relates to reed switches such as are used in, for example, relays and motion sensors, and more particularly to improvements in the design of such reed switches.

BACKGROUND OF THE INVENTION

Reed switches are used in a variety of devices, including relays of the electromagnetic and electromechanical type, as well as motion and proximity sensors. Reed switches include electrical contacts which are positioned to have a space or gap between them which can be selectively closed and reopened by relative movement of the contacts under the application of a force, such as magnetic or mechanical energy, so as to establish electrical contact between them. The electrical contacts are typically formed into relatively thin, flexible strips or blades of an electrically conductive material.

The responsiveness of the switch is determined in part by the choice of material for the switch contacts and the geometry of the contact blades. Typically the contact blade is made of a nickel/iron alloy and is designed to be sufficiently flexible so that it can move relatively easily under an applied force, such as a magnetic field, yet sufficiently rigid so that it can return to its unloaded orientation.

It is known to reduce the thickness of selected portions of the switch contact blade to enhance the compliance or flexibility of the blade and to optimize the magnetic coupling of the blades. This thinning of the blades is typically accomplished by stamping or pressing the blade in the desired areas. However, pressing or stamping can create burrs or other undesirable stress concentration points in the material. In addition, the material in the thinned regions of the blade is compressed and displaced and thus undergoes a change in its grain structure which is characterized by the term "work hardening" or "working". The work hardened regions of the blade are thus prestressed, whereas the unthinned regions of the blade retain the grain structure and stress-strain characteristics of the original unworked blade material and are not similarly stressed. Work hardening of the material causes it to be denser, less ductile, harder and more brittle, and thus less flexible under load. As a result, greater force is required to move a blade which has been work hardened, and a work hardened blade is less responsive and more likely to fail under load than one which has not been work hardened to achieve a desired geometry.

Flexible reed switches are disclosed in, for example, U.S. Pat. Nos. 3,258,557 to Scheepstra et al., 3,283,274 to De Falco, and 3,866,007, 3,893,051 and 3,943,474 to Schlesinger, Jr. et al. These patents describe reed switch contact blades which incorporate one or more relatively thin regions for enhanced flexibility and reduced contact bounce. The blades are rolled between cylindrical presses to be thinned or necked down in the desired regions.

As previously discussed, the rolling process tends to work the material. The thinned regions of these blades exhibit greater hardness, lower ductility and higher densities than are found in the unworked material, and thus the blades made according to these methods may be relatively weak and unreliable.

It would therefore be an advancement in the art of reed switches to provide reed switch blades which exhibit improved flexibility, performance and life characteristics and which are not subject to the undesirable effects of stamping or pressing.

SUMMARY OF THE INVENTION

A reed switch according to one aspect of the invention comprises:

A. A plurality of reed switch contact blades made of a substantially electrically conductive material;

B. A capsule made of a substantially electrically insulating material and enclosing a void region, wherein the blades are fixedly mounted in the capsule with portions of the blades extending into the void region and defining a contact region of the blades, those portions of the blades within the void region of the capsule being adapted for relative movement and being spaced apart from, and overlapping, one another at least partially to define a gap between the blades in the contact region; and C. Means for selectively closing the gap between the blades to establish an electrical connection between the blades;

wherein a predetermined amount of material is selectively removed from one or more portions of at least one of the blades in a predetermined pattern without working the remaining blade material.

The contact region of a blade can be configured as a single point contact, a multiple point contact, a single line contact, a multiple line contact, a single area contact, or a multiple area contact.

In an alternative embodiment, material can be removed in a predetermined pattern from the blade to define a hinge region. The hinge and contact regions of a blade are formed by exposing selected portions of the blade to an etching medium for a predetermined time to remove a predetermined amount of material from the blade. In a preferred embodiment, the etching medium is an acid.

The means for selectively closing the gap between the blades to establish an electrical connection between them preferably comprises means for selectively directing sufficient energy to the contact region of at least one of the blades to move the blade toward and away from at least one other blade.

In a preferred embodiment, the reed switch includes a pair of reed switch contact blades. In a switch employing more than two contact blades, one or more of the blades is substantially stationary relative to the other blades.

According to another aspect of the invention, there is provided a method of making a reed switch. The method comprises the steps of:

a. Providing a substantially electrically conductive material;

b. Selectively removing a portion of the material in one or more predetermined patterns without working the remaining material;

c. Forming a plurality of reed switch contact blades of predetermined dimensions from the material; and d. Fixedly mounting a plurality of the reed switch contact blades in a capsule made of a substantially insulating material and surrounding a void region therein so that portions of the blades from which material was removed in step b. are disposed within the void region of the capsule and define a contact region of the blades. The blade portions within the void region are adapted for relative movement and are spaced apart from, and at least partially overlap, one another to define a gap therebetween in the contact region. The portions of the blades within the void region of the capsule are activatable to selectively close the gap between the blades to establish an electrical connection therebetween.

The step of selectively removing a portion of the material preferably includes the steps of:

I. Applying a masking medium to portions of the material in a predetermined pattern using photolithographic techniques to obtain a masked surface;

ii. exposing the masked surface to an etching medium for a predetermined time to remove selected portions of material from unmasked regions of the surface; and iii. Removing the masking medium from the surface.

In a preferred embodiment, a pair of reed switch contact blades is mounted in the capsule. If more than two reed switch contact blades are employed in a switch, one or more of the blades is substantially stationary relative to the other blades.

According to another aspect of the invention, there is provided a reed switch contact blade which comprises an elongated, thin segment of an electrically conductive material extending along a principal axis between a mounting end and a contact end. A predetermined amount of material is removed from selected portions of the segment in predetermined patterns without working the remaining material of the segment.

These and other objects and advantages of the invention will in part be obvious and will in part appear hereinafter. The invention accordingly comprises the apparatus possessing the construction, combination of elements and arrangement of parts which are exemplified in the following detailed disclosure, the scope of which will be indicated in the claims.

BRIEF DESCRIPTION OF THE DRAWINGS

For a fuller understanding of the nature and objects of the present invention, reference should be had to the following detailed description taken in connection with the accompanying drawings, in which.

DETAILED DESCRIPTION OF THE DRAWINGS

The reed switch of the present invention employs contact blades which exhibit improved magnetic coupling over those which have been stamped or pressed. Improved magnetic coupling is obtained by providing a contact region at the end of the blade which has a geometry that preserves magnetic mass, yet reduces the contact area, thus reducing the electrical capacitance of the space between the blades, and improving the responsiveness of the switch. In addition, because at least one of the contact blades in a reed switch is movable relative to other contacts, some of which may be stationary, improved flexibility of the movable contact blades is obtained by providing the blade with at least one hinge or fulcrum region to facilitate movement of the blade under a load, such as when a magnetic force is applied.

According to the present invention, the reed switch blades are reduced in thickness in desired locations using an acid etch procedure to remove material from the blade to form one or more contact regions and, if increased blade flexibility is desired, one or more hinge regions. A principal advantage of removing material from the blade by acid etching instead of displacing the material by stamping or pressing it is that the material which remains in the reduced-thickness regions is not work hardened or otherwise stressed, contains no burrs or other stress concentrators, and retains the characteristics of the original blade material. Other advantages include the ability to control the material removal process to a relatively great extent, which allows the designer to fabricate contact blades with enhanced performance features, as will be detailed more fully below.

Figure 1A:
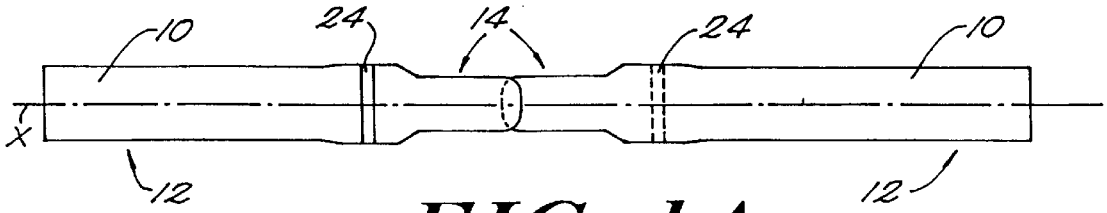
FIG. 1A is a plan view of a pair of reed switch contact blades as used in a reed switch.
Figure 1B:
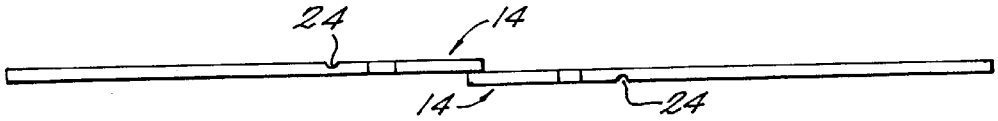
FIG. 1B is a side view of the contact blades shown in FIG. 1A.
Figure 2A:
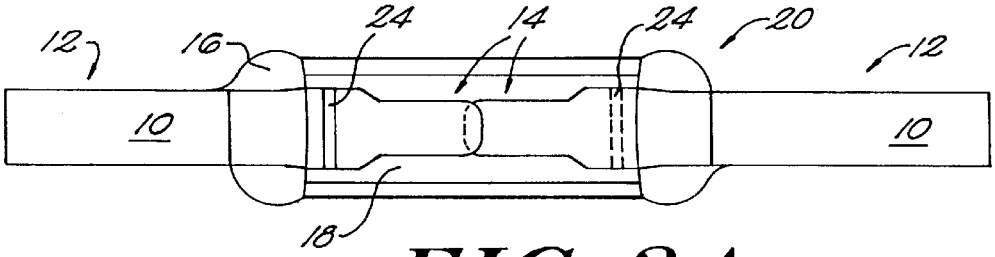
FIG. 2A is a plan view of a portion of a reed switch.
Figure 2B:
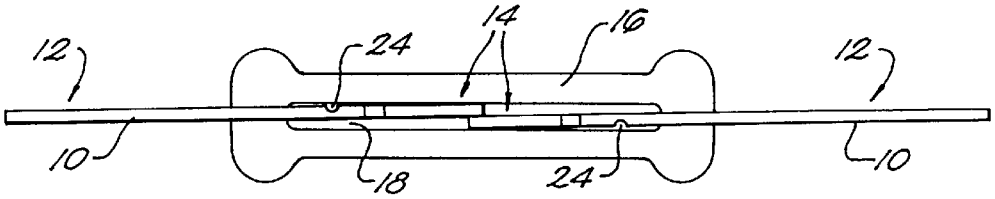
FIG. 2B is a side view of the portion of the switch shown in FIG. 2A.
Figure 3A:
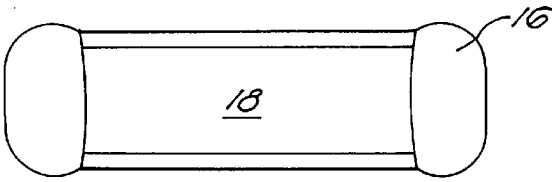
FIG. 3A is a plan view of an insulating capsule used in a reed switch.
Figure 3B:
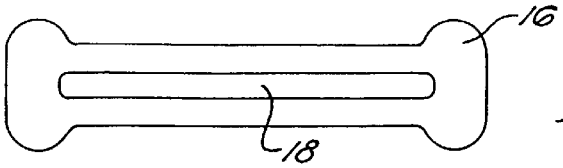
FIG. 3B is a side view of the capsule shown in FIG. 3A.
Figure 17A:
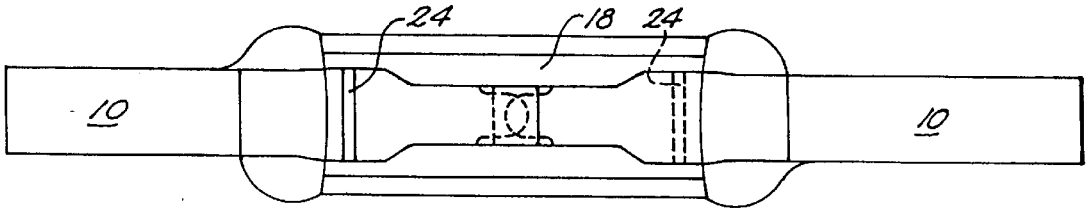
FIG. 17A is a plan view of a reed switch employing reed switch blades having a contact region as illustrated in FIGS. 8 and 15.
Figure 17B:
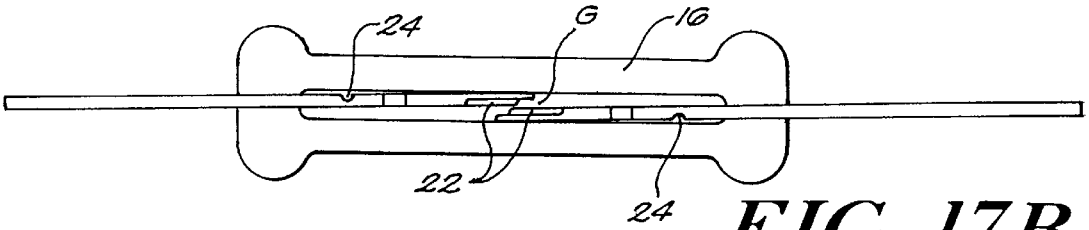
FIG. 17B is a side view of the reed switch shown in FIG. 17A.

FIG. 1 illustrates a pair of reed switch contact blades 10. The blades may extend as shown along a principal axis X or may have any other suitable shape. They may be substantially flat, as shown in FIG. 1B, or they may have a substantially circular or other polygonal cross-section. The blades are oriented in FIG. 1 as they would typically be oriented in a reed relay switch 20, shown in FIGS. 2A and 2B. The blades 10 include a mounting end 12 and a contact end 14. Each blade is typically fixedly mounted in an insulating capsule 16, shown most clearly in FIGS. 3A and 3B, with its contact end 14 disposed within an interior void region 18 of the capsule and its mounting end 12 extending out of the capsule, as shown in FIGS. 2A and 2B. The blades are sealed into the capsule so that at least one of the contact ends 14 is movable relative to the other. The ends of the blades at least partially overlap, as shown in FIGS. 1A, 1B, 2A and 2B, to define a gap or space G (shown in FIG. 17B) between the overlapping ends, so that under an applied force, such as from a magnetic field, an electrical connection is established between the overlapping portions of the blades. The size of the gap G is not critical and can vary according to, for example, the size of the blades and the capsule, the magnitude of the expected force on the blades, the inherent flexibility of the blades, and other factors.

The contact end 14 of the blade is preferably formed as an extension of the main portion of the blade and may be narrower in width than the main body of the blade, as shown in FIGS. 1A and 2A.

Figure 7:
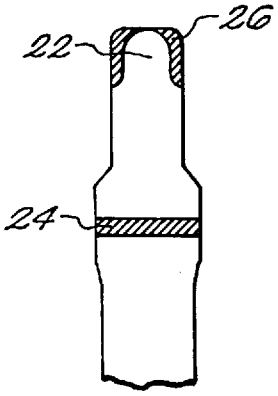
Figure 8:
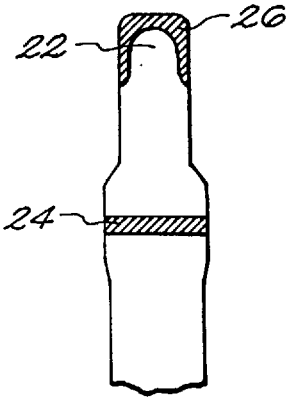

In one embodiment of the invention, as shown, for example, in FIGS. 7 and 8, a portion of the blade at the contact end 14 is removed in a predetermined pattern to leave one or more contact regions 22, through which the electrical and physical connection is made when the gap between opposing blades is selectively closed. The material is preferably removed by an acid etch process to leave an etched region 26, shown in the FIGURES as a hatched region. In preparation for the etching process, the contact end 14 of the blade is masked in a predetermined pattern, as detailed more fully below, so that only those portions of the contact end to be reduced in thickness are exposed to the etching medium.

The blade can be etched from any of its surfaces. In some applications it may be desirable to etch the blade only from one surface, as shown, for example, in FIGS. 15A–15C. In other applications material may be removed from one surface to obtain an etched contact region, and from another surface to obtain an etched hinge region, as illustrated in, for example, FIGS. 16B and 17B. The amount of material which is removed is a function of the time of exposure of the blade material to the etching medium and can vary from a virtually negligible amount up to the maximum thickness of the blade. Clearly, if the blade is exposed to the etching medium for a sufficient time, all of the exposed material will be etched away. However, it is generally preferable to stop the material removal process before the entire thickness of the blade has been etched away, in order to preserve the magnetic mass of the blade and provide for enhanced blade alignment and magnetic coupling in the contact region.

The blades 10, if of the movable variety instead of the stationary variety in a switch, may include one or more hinge or fulcrum regions 24, which are preferably located near the seal of the capsule around the blade, as shown, for example, in FIGS. 2A and 2B. A blade which includes a hinge region 24 bends preferentially at the hinge region 24 under an applied load. As illustrated in FIGS. 5, 6, 10, 12, 13, 14, 16A and 16B, a second hinge region 24' may be located relatively close to the contact end 14. The latter hinge region provides the contact end of the blade with enhanced flexibility under load and may prevent excessive contact bounce or chatter of the blades, and thus intermittent electrical connections, when they contact each other under an applied load.

In an alternative embodiment, material can be removed from one or more portions of the blade to define one or more hinge or fulcrum regions 24. The hinge region 24 is preferably formed as a trench or trough extending transversely to the principal axis of the blade. As previously mentioned, the depth of the hinge region may extend up to the full the thickness of the blade, although it is preferred to leave some material to preserve magnetic mass. A hinge region having a depth of approximately one-half the thickness of the blade is suitable for many applications. The profile of the hinge region is preferably rounded or otherwise smoothly contoured so as to avoid the introduction of stress concentration points into the blade. A single hinge region may preferably be located somewhere between the contact end and the mounting end of the blade. Additional hinge regions may be preferably located at or near the contact region to enhance the flexibility of the blade in that region.

Figure 4:
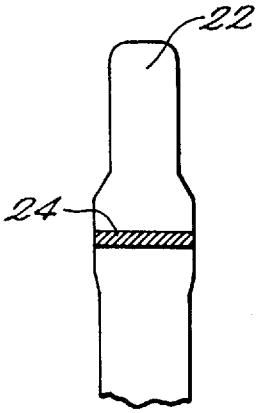
FIGS. 4–14 are plan views of a portion of a reed switch contact blade having various configurations for the contact region at an end of the blade.

FIGS. 4–14 illustrate various geometries of hinge and contact regions which can be formed in reed switch blades according to the invention. FIG. 4 illustrates a reed switch contact blade which includes a single hinge region 24 and an intact (unetched) contact region 22. The contact region 22 thus extends over the full area of the contact end 14 of the blade. A blade having this contact and hinge region geometry is employed in the switch shown in FIGS. 2A and 2B.

Figure 5:
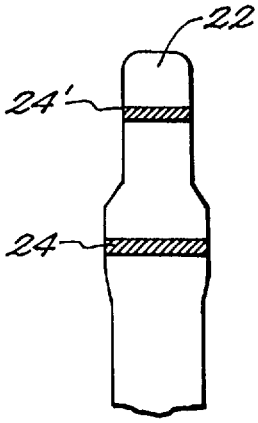

The blade shown in FIG. 5 has two hinge regions 24 and 24', one relatively near the seal and the other relatively near the contact end of the blade. Both hinge regions function to increase the compliance or flexibility of the blade. The hinge region near the contact end particularly enhances the flexibility of the contact region.

Figure 6:
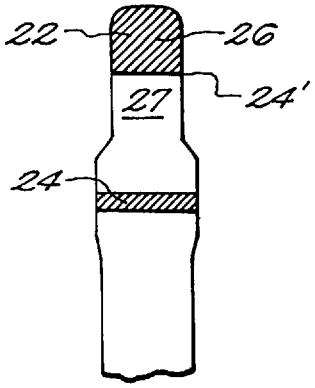

FIG. 6 illustrates a reed switch blade which includes a single hinge region 24 and an etched region 26 which is coextensive with the contact region 22. This type of blade configuration is shown in plan view in FIG. 16A and in side view in FIG. 16B. The boundary between the etched portion 26 and the unetched portion 27 of the blade functions as a second hinge region 24' near the contact region for enhanced flexibility of the blade in the contact region. An advantage of a switch employing blades such as in FIG. 6 is that the extent of overlap of the opposing blades can be increased, thereby enhancing the alignment of the opposed blades, and thus increasing the magnetic coupling of the switch, within the relatively confined void region of the capsule.

FIGS. 7 and 8 illustrate blades each having a single hinge region 24 and a contact region 22 partially surrounded by an etched region 26. The etched region 26 of the blade shown in FIG. 8 is more extensive than that of the blade of FIG. 7, thus providing a contact region 22 which is comparatively reduced in area. A smaller contact area corresponds to a reduced electrical capacitance across the space between the blades and may therefore be desirable in some applications. As with the blade of FIG. 6, the extent of overlap of the opposing blades with this contact region design can be increased, thereby enhancing the alignment of the opposed blades, and thus increasing the magnetic coupling of the switch.

Figure 9:
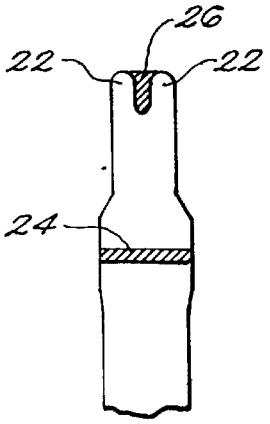
Figure 10:
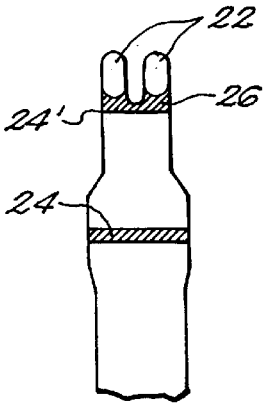
Figure 11:
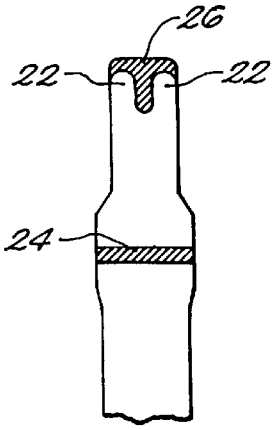

FIGS. 9, 10 and 11 illustrate blades each having a single hinge region 24 and a bifurcated contact region 22. In the blades shown in FIGS. 9 and 11, the material between the bifurcated contact region 22 is partially removed. The contact region 22 is bifurcated inasmuch as it is separated by an etched region 26 of reduced-thickness blade material. Nonetheless, the contact end of these blades is a solid, intact structure. In contrast, the contact end of the blade shown in FIG. 10 is truly bifurcated, as a portion of the material between the contact regions 22 has been removed entirely. In general, for optimum reed switch performance, a reduction in the thickness of the contact region is preferred over an outright removal of a portion of the contact end, as the former preserves magnetic mass and enhances the alignment of the blades and thus the magnetic coupling of the switch.

In the blade shown in FIG. 10, the etched region 26 forms an intermediate thinned region between the bifurcated contact regions 22 and the remaining portion of the blade. As previously described, the boundary between the etched portion 26 and the unetched portion 27 functions as a second hinge region 24' near the contact region, to enhance flexibility of the blade in the contact region.

Figure 12:
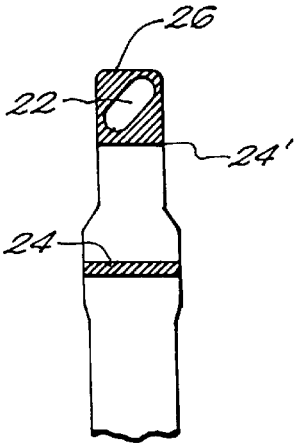

FIG. 12 illustrates a blade which has a single hinge region 24 and an elongated contact region 22 surrounded by an etched region 26 at the contact end of the blade. The size of the contact region 22 may vary, depending on the requirements of the switch, and may be either larger or smaller than pictured in this FIGURE. When paired with an identically etched blade, the contact regions of this type of blade meet to form a so-called cross-point contact at the intersection of the elongated regions 22. The cross-point contact can be in the shape of an X or a +. It defines and precisely locates a relatively small contact area through which electrical and physical contact is established. Magnetic coupling is maintained by virtue of the presence of a relatively large area of overlap between the blades, while electrical capacitance in the space between the blades is minimized as a result of the relatively small contact area. In addition, the precise location of the contact point is advantageous, as it reduces variability in the contact resistance, the load carrying capacity of the contact point or points, and the electrical life of the contacts.

Figure 13:
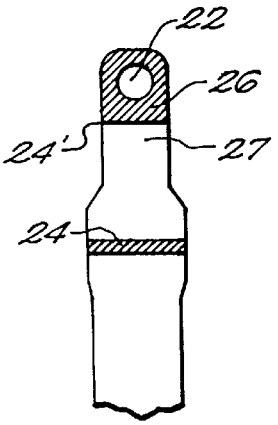
Figure 14:
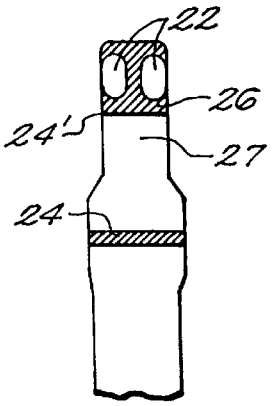

FIG. 13 illustrates a blade having a relatively small contact region 22 surrounded by an etched region 26, with a secondary hinge region 24' for enhanced blade flexibility near the contact region. FIG. 14 illustrates a blade having two relatively small contact regions 22 surrounded by an etched region 26. The size of the contact region 22 can of course be varied to provide contact through one or more defined areas, lines or points, as desired.

Figure 15:
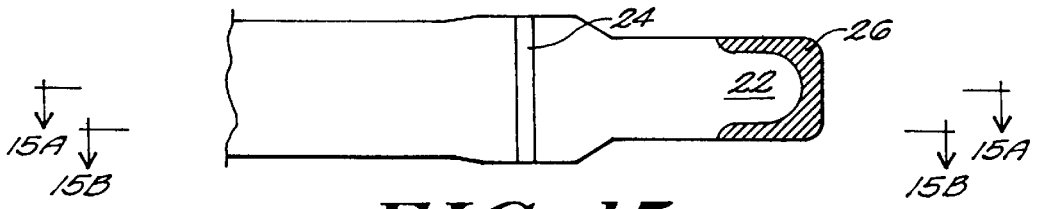
FIG. 15 is an enlarged view of the reed switch contact blade shown in FIG. 8.
Figure 15A:
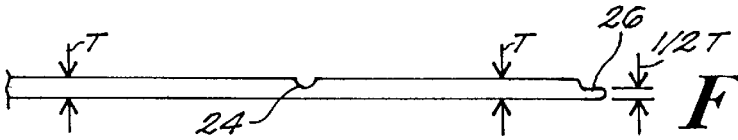
FIG. 15A is a section view of the reed switch contact blade shown in FIG. 15, taken along section lines A—A.
Figure 15B:
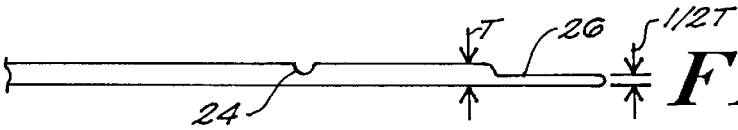
FIG. 15B is a section view of the reed switch contact blade shown in FIG. 15, taken along section lines B—B.
Figure 15C:
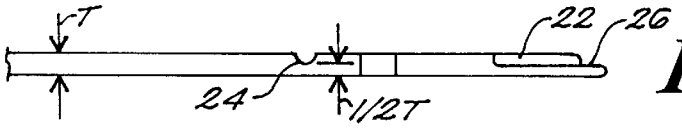
FIG. 15C is a side view of the reed switch contact blade shown in FIG. 15.
Figure 16A:
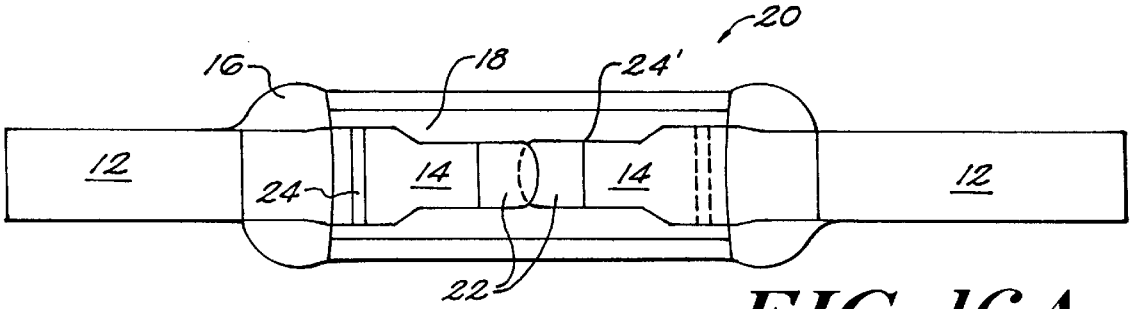
FIG. 16A is a plan view of a reed switch employing reed switch blades having a contact region as illustrated in FIG. 6.
Figure 16B:
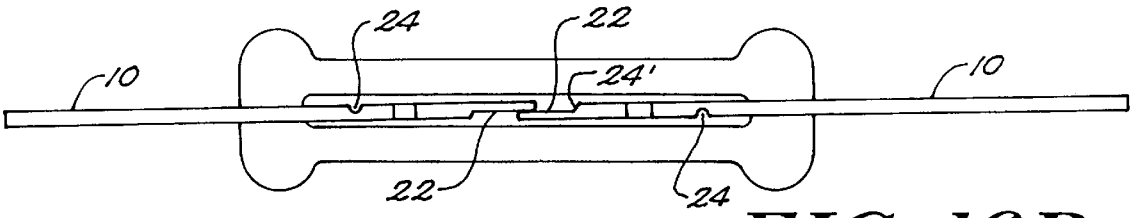
FIG. 16B is a side view of the reed switch shown in FIG. 16A.

FIGS. 15–15C illustrate in detail the profiles of the hinge region 24, contact regions 22 and etched region 26 of a typical blade according to the invention. In a preferred embodiment, the hinge region 24 is shown to be a relatively narrow trench or channel of reduced material thickness. In the blade illustrated in FIG. 15C, the depth of the hinge region is approximately one-half the total thickness T of the blade. However, as previously mentioned, material can be removed from the blade to any depth. Material is removed from the hinge region in a smoothly contoured profile so as to avoid the introduction of sharply angled pits or crevices, and thus stress points, to the blade. Reduction of blade thickness in a well-defined hinge region increases blade flexibility by reducing the amount of force required to move the blade.

Similarly, the contact region 22 illustrated in the blade of FIGS. 15–15C is formed by removing material in etched region 26 to a depth of one-half the thickness T of the blade. As with the hinge region, to define a contact region, material can be removed from the blade to any depth, up to the thickness of the blade. The etched region 26 extends partially around the raised contact region 22 in this embodiment.

A method for removing material from the blade to obtain the desired geometry and location for the hinge and contact regions involves the masking of the blade in a desired pattern using photolithographic techniques. The etching medium is typically an acid, such as, for example, hydrofluoric (HF) acid. After the blade is masked to provide a desired etch pattern, the masking medium is photographically exposed so that the desired contact regions 22 are protected from the acid solution, and only those regions which are to be etched away are exposed to the acid solution. The etching process is carried out by exposing the masked blade to the etching medium for a predetermined amount of time to achieve material removal to the specified depth. After the etching process is completed, the masking medium is removed from the blade. If material is to be removed from only one surface of the blade, that surface of the blade only is masked as desired, photographically exposed, and then exposed to the etching medium as described above.

As previously mentioned, physical and electrical contact with this blade can be established through one or more points, lines, or areas, depending on the geometry of the contact region of the opposing blade. In addition, the blades in a reed switch do not have to be identically etched or otherwise have an identical pattern of hinge and contact regions. For example, two opposing blades configured as shown in FIG. 12 spaced apart by a gap will establish a cross-point contact when the gap is closed upon application of a force to one or both of the blades. If a blade as shown in FIG. 4 is paired with a blade as shown in FIG. 12, the resulting contact will be along a diagonal line when the gap is closed, if the contact region 22 on the blade of FIG. 12 is relatively narrow, or along a diagonally disposed area when the gap is closed, if the contact region is relatively wide.

The blades 10 are preferably made of an electrically conductive material, such as copper, or an alloy containing, for example, copper, nickel, silver, platinum, gold and/or aluminum. A preferred material for the blades is a nickel/iron alloy, such as, for example, Alloy 52, which nominally contains 52 weight percent nickel and 48 percent iron.

The capsule is made of an electrically insulating material, such as, for example, glass, ceramic, plastic, or any insulating material which is capable of holding and securing the contact blades.

The net reduction in capacitance which can be obtained with a reed switch blade formed according to the invention is proportional to the area of the material removed by the procedures outlined herein.

Figure 18A:
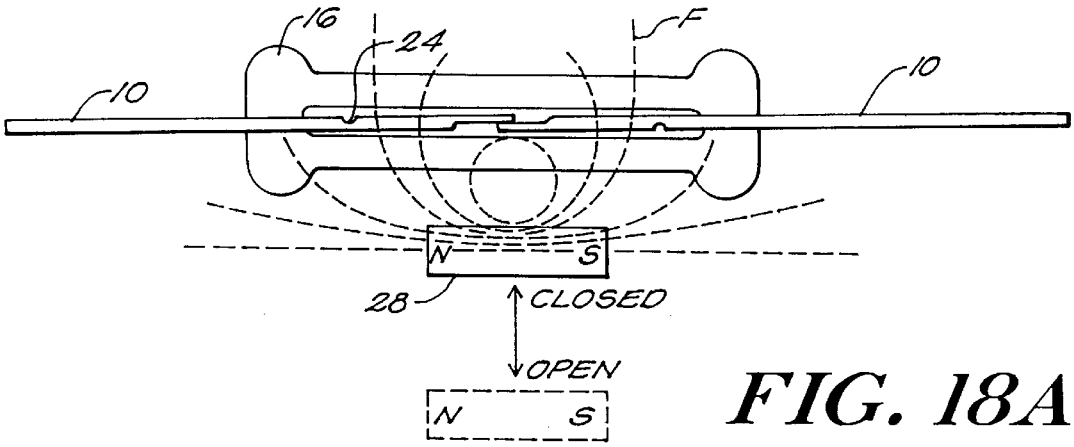
FIGS. 18A–B are schematic diagrams illustrating the typical operation of a reed switch made according to the invention.
Figure 18B:
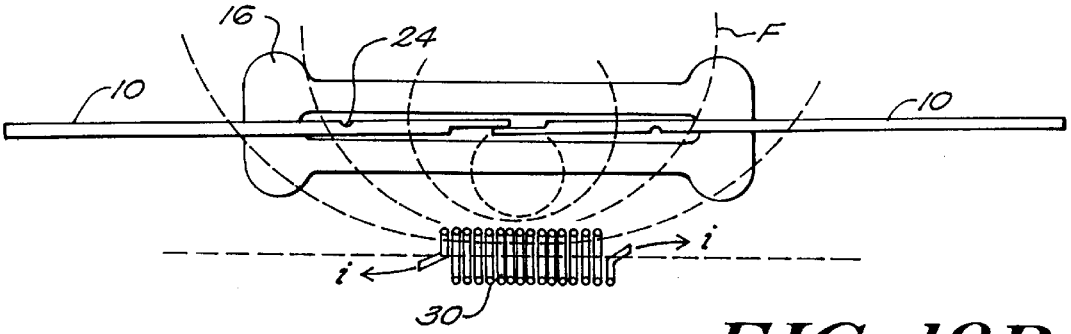

FIGS. 18A and 18B illustrate the operation of, respectively, a magnetic reed relay switch and an electromagnetic reed relay switch according to the invention. The reed switch blades 10, or leads, sense the flux of a magnetic field, designated in the FIGURES as dashed lines F. The longer the length of the blade, the more sensitive it is to a magnetic field; shorter blades, while desirable from a space economy standpoint, are correspondingly less sensitive. However, the incorporation of one or more hinge regions 24, 24' in any of the moving blades enhances the responsiveness of a relatively short blade to an applied force.

The switch can be activated by either a permanent magnet 28, shown in FIG. 18A, or an electromagnetic coil 30, shown next to the switch in FIG. 18B. When the reed switch is placed near a permanent magnet, or either inside or close to a coil of wire and a current i is passed through the coil, as shown in FIG. 18B, each blade of the reed switch becomes strongly magnetized. One end of the switch becomes a north pole and the other becomes a south pole. Because the blades overlap in the center of the capsule 16 with a gap of only a few thousandths of an inch separating the overlapping ends, each blade will have both a north and a south pole. The overlapping reed blades come together to close the gap when the permanent magnet is moved close to the switch, or when the electrical current generates sufficient magnetic flux in the coil. When the permanent magnet is moved away, or when current to the coil is turned off, the reed switch blades return to their open condition. The reed switch can be either a normally-open or normally-closed type.

Because certain changes may be made in the above apparatus without departing from the scope of the invention herein disclosed, it is intended that all matter contained in the above description or shown in the accompanying drawings shall be interpreted in an illustrative and not a limiting sense.

What is claimed is:

1. A reed switch, comprising:

A plurality of reed switch contact blades, each blade having at least one unthinned portion of a nominal thickness and a predetermined grain structure and being made of a substantially electrically conductive material;

A capsule made of a substantially electrically insulating material and enclosing a void region, wherein the blades are fixedly mounted in the capsule with portions of the blades extending into the void region and defining a contact region of the blades, wherein the portions of the blades in the void region of the capsule are adapted for relative movement, wherein the blades in the void region of the capsule are spaced apart from, and overlap, one another at least partially to define a gap therebetween in the contact region; and Means for selectively closing the gap between the blades to establish an electrical connection therebetween;

wherein at least one portion of at least one of the blades is thinner than each unthinned portion of the blade as a result of selective removal of material therefrom in a predetermined pattern wherein each thinner portion has the same grain structure as each unthinned portion of the blade.

2. A reed switch according to claim 1, wherein one of the thinner portions of a blade is located in the contact region of the blade.

3. A reed switch according to claim 2, wherein the contact region of a blade includes a single point contact.

4. A reed switch according to claim 2, wherein the contact region of a blade includes a multiple point contact.

5. A reed switch according to claim 2, wherein the contact region of a blade includes a single line contact.

6. A reed switch according to claim 2, wherein the contact region of a blade includes a multiple line contact.

7. A reed switch according to claim 2, wherein the contact region of a blade includes a single area contact.

8. A reed switch according to claim 2, wherein the contact region of a blade includes a multiple area contact.

9. A reed switch according to claim 1, wherein one or more of the thinner portions of a blade is located in one or more corresponding hinge regions of the blade.

10. A reed switch according to claim 1, wherein the thinner portions of the blade are formed by exposing selected portions of the blade to an etching medium for a predetermined time to remove a predetermined amount of material therefrom.

11. A reed switch according to claim 10, wherein said etching medium is an acid.

12. A reed switch according to claim 1, wherein said means for selectively closing the gap between the blades to establish an electrical connection therebetween comprises means for selectively directing sufficient energy to the contact region of at least one of the blades to move the blade toward and away from at least one other blade.

13. A reed switch according to claim 1, comprising a pair of reed switch contact blades.

14. A reed switch according to claim 1, comprising more than two reed switch contact blades, wherein one or more of the blades is substantially stationary relative to the other blades.

15. A reed switch contact blade, comprising:

An elongated segment of an electrically conductive material having at least one unthinned portion of a nominal thickness and a predetermined grain structure and extending along a principal axis between a mounting end and a contact end, wherein at least one portion of the segment is thinner than each unthinned portion of the segment as a result of selective removal of material therefrom in a predetermined pattern, wherein each thinner portion has the same grain structure as each unthinned portion of the segment.

16. A reed switch contact blade according to claim 15, wherein one or more of the thinner portions of a blade is located in one or more corresponding contact regions for establishment of electrical contact therethrough.

17. A reed switch contact blade according to claim 16, wherein the contact region of a blade includes a single point contact.

18. A reed switch contact blade according to claim 16, wherein the contact region of a blade includes a multiple point contact.

19. A reed switch contact blade according to claim 16, wherein the contact region of a blade includes a single line contact.

20. A reed switch contact blade according to claim 16, wherein the contact region of a blade includes a multiple line contact.

21. A reed switch contact blade according to claim 16, wherein the contact region of a blade includes a single area contact.

22. A reed switch contact blade according to claim 16, wherein the contact region of a blade includes a multiple area contact.

23. A reed switch contact blade according to claim 15, wherein one or more of the thinner portions of the blade is located in one or more corresponding hinge regions of the blade for increased flexibility of the blade.

24. A reed switch contact blade according to claim 15, wherein the thinner portions of the blade are formed by exposing selected portions of the blade to an etching medium for a predetermined time to remove a predetermined amount of material therefrom.

25. A reed switch contact blade according to claim 24, wherein the etching medium is an acid.

* * * * *